US006530606B2

(12) United States Patent
Lehner

(10) Patent No.: US 6,530,606 B2
(45) Date of Patent: Mar. 11, 2003

(54) FASTENING ELEMENT FOR FITTING PARTS

(75) Inventor: Michael Lehner, Hunzenschwil (CH)

(73) Assignee: KWC AG, Unterkulm (CH)

( * ) Notice: Subject to any disclaimer, the term of this patent is extended or adjusted under 35 U.S.C. 154(b) by 0 days.

(21) Appl. No.: 09/985,906

(22) Filed: Nov. 6, 2001

(65) Prior Publication Data

US 2002/0079701 A1 Jun. 27, 2002

(30) Foreign Application Priority Data

Dec. 21, 2000 (CH) ..... 2496/00

(51) Int. Cl.[7] ..... F16L 27/08
(52) U.S. Cl. ..... 285/321; 285/305; 285/307
(58) Field of Search ..... 285/305, 321, 285/307, 314, 276

(56) References Cited

U.S. PATENT DOCUMENTS

| | | | | | |
|---|---|---|---|---|---|
| 3,920,270 | A | * | 11/1975 | Babb, Jr. | 285/104 |
| 4,083,410 | A | * | 4/1978 | Anderson | 169/37 |
| 4,105,226 | A | * | 8/1978 | Frey et al. | 285/148.21 |
| 4,635,974 | A | * | 1/1987 | Moussaian | 285/305 |
| 4,804,206 | A | * | 2/1989 | Wood et al. | 285/13 |
| 5,002,318 | A | * | 3/1991 | Witter | 169/37 |
| 5,014,749 | A | | 5/1991 | Humpert et al. | |
| 5,515,882 | A | | 5/1996 | Hennis | |
| 5,595,213 | A | * | 1/1997 | Brown | 137/515.5 |
| 5,681,060 | A | * | 10/1997 | Berg et al. | 285/305 |
| 5,873,387 | A | | 2/1999 | Weber et al. | |
| 2001/0002754 | A1 | * | 6/2001 | Dobler et al. | 285/321 |

FOREIGN PATENT DOCUMENTS

| | | |
|---|---|---|
| EP | 0 386 594 B1 | 9/1990 |
| EP | 0 386 594 A1 | 9/1990 |
| WO | WO 98/13641 | 4/1998 |

* cited by examiner

*Primary Examiner*—Eric K. Nicholson
(74) *Attorney, Agent, or Firm*—Oliff & Berridge, PLC

(57) ABSTRACT

The fastening element is intended for two hydraulically communicating fitting parts (1, 2). In order to fasten a lateral fitting part (2) on the end face to an outer wall (8) of a wide fitting part (1) at a predetermined angle, the lateral fitting part (2) has, in one end region, a cavity (4) in which an inner peripherally formed groove for a spring ring (12) is located. The fastening element (7) comprises a connecting insert (9) which is mounted in this cavity (4) of the lateral fitting part (2) and which carries a threaded shank (10) with a bore (15), in order to allow hydraulics communication between the two fitting parts (1, 2). The connecting insert (9) has an outer peripherally formed groove such that a spring ring (12) is mounted unreleasably between these two grooves.

15 Claims, 2 Drawing Sheets

3
4
6
2
7
10
11
13
12
15
9
14
8
5
1

12

B
12

B
36
35

37
21
33
34
12

FASTENING ELEMENT FOR FITTING PARTS

BACKGROUND OF THE INVENTION

1. Field of the Invention

The present invention relates to a fastening element for fitting parts according to the preamble of patent claim 1, to a spring ring according to claim 9 and to a fitting according to claim 10.

2. Summary of the Invention

The object of the invention is to provide a fastening element for fittings or fitting parts which is relatively uncomplicated and makes simple mounting possible.

This object is achieved by means of a fastening element having the features specified in patent claim 1.

Further advantageous embodiments of the invention are as specified in the dependent claims.

The invention is explained in more detail below by way of example., with reference to drawings in which:

DETAILED DESCRIPTION OF THE PREFERRED EMBODIMENTS

Figures 1, 3, 4, 5, 6:
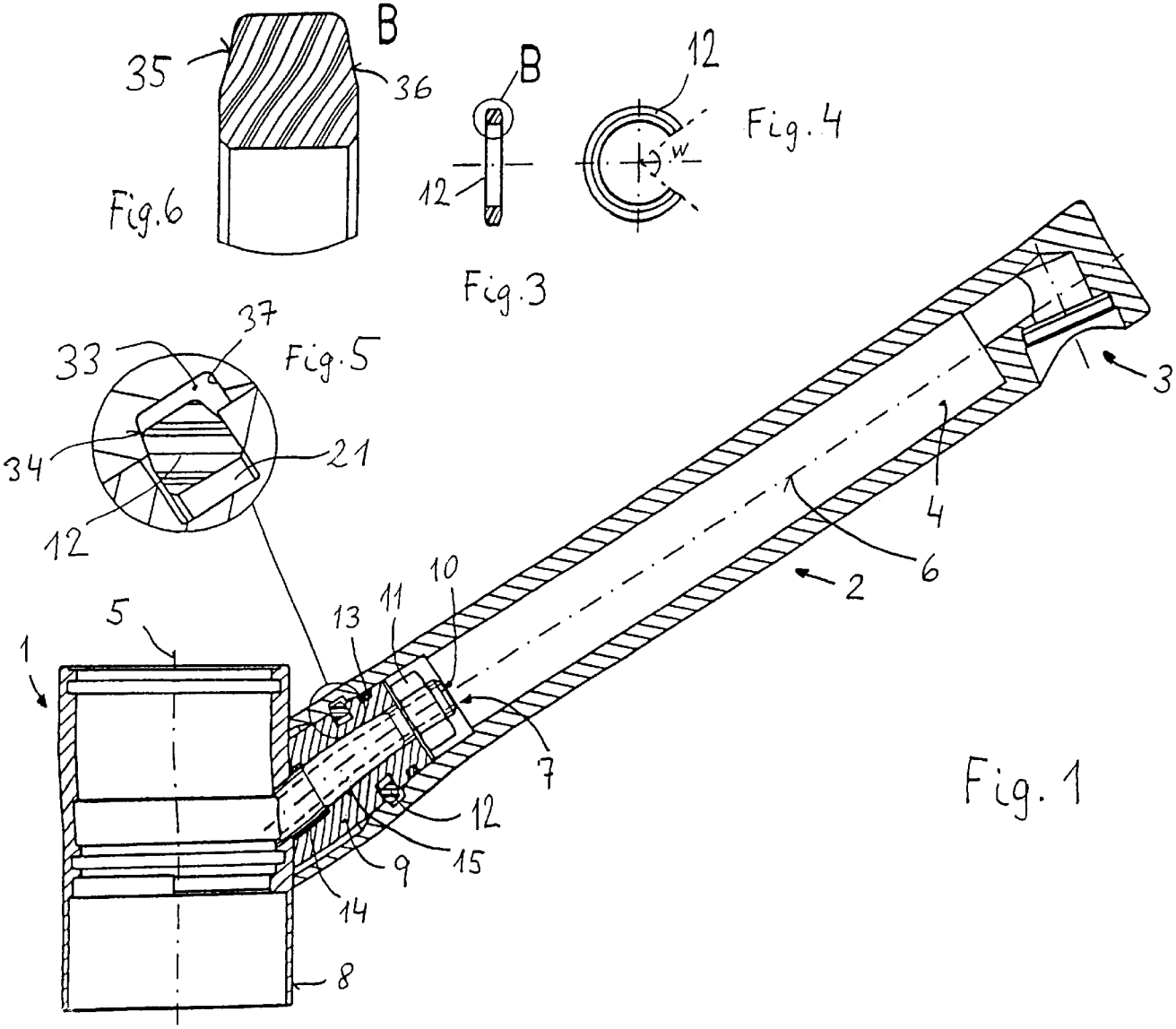
FIG. 1 shows a diagrammatic illustration of two fitting parts which are connected to one another by means of an installed fastening element according to the invention.
FIG. 3 shows a side view of a spring ring for such a fastening element.
FIG. 4 shows a top view of such a spring ring.
FIG. 5 shows an illustration of a detail to explain the operation of such a spring ring.
FIG. 6 shows an enlarged cross section of the edge of such a spring ring.

FIG. 1 shows two fittings, parts 1 and 2, which may be, for example, a housing, a tubular piece, a hydraulic appliance, etc., said figure illustrating, in particular, preferably a wide fitting part 1 in the form of a housing part of a water fitting with an at least approximately cylindrical outer contour and a lateral fitting part 2 in the form of an outflow pipe with an outflow 3 for water or another liquid. The term "hydraulic" refers, within the meaning of the invention, to any liquid. The outflow pipe 2 has an axial cavity or passage 4 which communicates with an orifice forming the outflow 3. The fitting parts 1 and 2 have in each case axially symmetric axes 5 and 6, which are located in one and the same plane, and are connected in close contact to one another by means of a fastenings element 7. One end (30 in FIG. 2) of the fittings, part 2 is in contact with the outside of the cylindrical wall 8 of the fitting part 1 which has the larger diameter. The cylindrical wall 8, the shape of which is not appreciably impaired by this contact, is thus in contact with a sectional plane of the fitting part 2, said sectional plane being designed for this purpose in the special form of what is known as a penetration, so that the shape of this end (30 in FIG. 2) of the fitting part 2 is matched to the outer surface of the cylindrical wall 8 of the fitting part 1. The tubular fitting part 2, which has the smaller diameter, can thereby be joined, flush, to the fitting part 1 at a predetermined angle. A sharp contact edge is thereby formed, as seen from outside, between the fitting parts 1 and 2.

Figure 2:
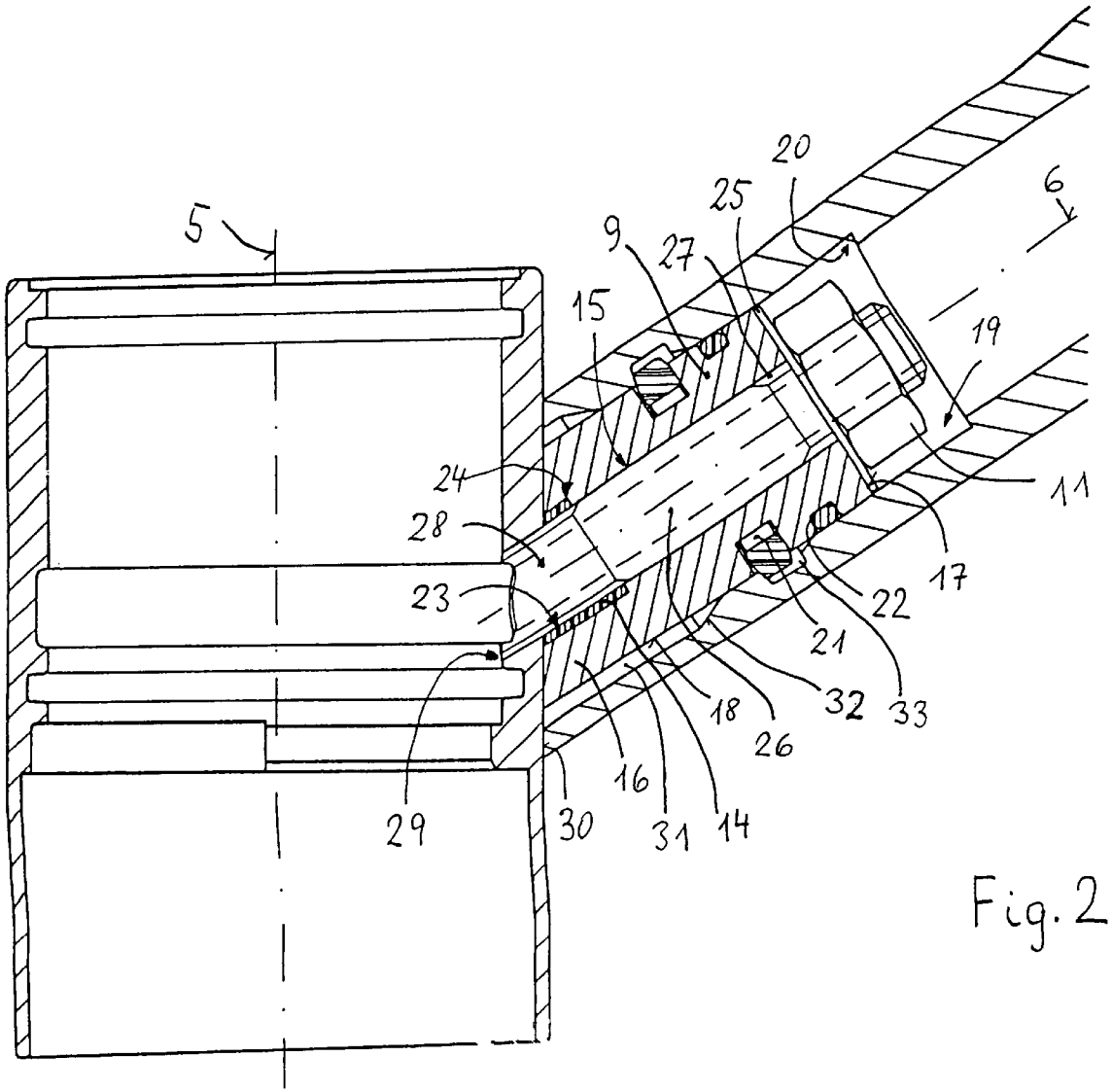
FIG. 2 shows an enlarged partial illustration of such a fastening element.

The fastening element 7 according to FIGS. 1 and 2 comprises a plurality of parts, to be precise: a connecting insert 9, a threaded shank 10 with a nut 11, a spring ring 12 (FIGS. 3 to 6), a sealing ring 13 and a special seal 14. The connecting insert 9 has a circular cross section and is provided with an axial continuous bore 15. The connecting insert 9 itself may consist of one, two or more parts; it is preferably of one-piece design, and it is therefore also referred to as a pipe connection piece.

FIG. 2 shows further details of the fastening element 7 according to the invention. A region 16 at one end of the pipe connection piece 9 is likewise designed as a penetration so that it can be added flush to the fitting part 1. The other end of the pie connection piece 9 is delimited by an end face 17 formed perpendicularly to the axis 6. The pipe connection piece 9 has a cylindrical outer surface 18, so that it can be introduced slideably with only a little play into a bore 19 at one end of the fitting part 2 as far as a shoulder 20. The pipe connection piece 9 also has a relatively wide and deep groove 21 for the spring ring 12 and a smaller groove 22 for the sealing ring 13. The grooves 21 and 22 are designed to be parallel to the end face 17. In the region of the end 16 of the pipe connection piece 9, there is formed by a widened inner bore 23, as far as a shoulder 24, an air gap where the special seal 14, for example a silicone seal, is accommodated. The end portion of which is preferably likewise designed as a penetration, so that it can be added, flush, to the fitting part 1. The nut 11 presses against the end face 17 via a curved washer 25.

The threaded shank 10 has a coaxial inner bore 26 and, on the outside, is provided with a middle smooth outer surface between a first region 27 having an external thread for the nut 11 at one end and a second region 28 likewise having an external thread at the other end. The cylindrical wall 8 of the fitting part 1 has a continuous oblique internally threaded wall 29 which is formed coaxially to the axis 6. The end region 28 is screwed into this bore 29. The end of the threaded shank of this side is shaped at least approximately according to the inner contour of the fitting part 1.

FIG. 3 shows the lateral shape of the spring ring 12 which, as may be gathered from FIG. 4, is not completely annular since it has a cutout at an angle w from about 30° to 110°. A resilient clamping piece may also otherwise serve as a spring ring 12.

The fitting, part 2 (FIG. 2) has, adjacent to its oblique end a widened inside diameter, so that there is an air gap 31 as far as a transitional ramp 32. Between the ramp 32 and the end face 17 of the pipe connection piece 9, in the mounted state, there is, on the inside of the fitting part 2, a peripheral groove 33 which is designed to have the spring ring .12 clamped in it in such a way that the pipe connection piece 9 can be held firmly on the fitting part 2 and be pressed against the latter.

Preferably, as illustrated in FIG. 5, that wall or flank 34 of the groove 33 which faces the fitting part 1 is preferably designed to be inclined inward. Moreover, as illustrated in FIG. 5 and 6, the edge region of the cross section of the spring ring 12 is in the shape of a symmetrical trapezium, the small unequal side being located at the outer edge between two preferably oblique or inclined flanks 35 and 36 which, in particular, may also be designed symmetrically, and the flank 34 and 35 having the same inclination.

The fastening element according to FIGS. 1 to 6 functions as follows:

First, the oblique end region 28 of the threaded shank 10 is screwed into the threaded bore 29 of the wall 8, until the inner end of said threaded shank is at least approximately in alignment with the inner contour of the fitting part 1. The pipe connection piece 9, if appropriate with the seal 14 mounted, is then pushed over the threaded shank 10, until said pipe connection piece comes to bear at least approximately with one end face against the fitting part 1 in a suitable rotary position and the threaded end region 27 of the threaded shank 10 projects from the bore 15. Finally, the nut 11 on the portion 27 is screwed down and preferably tightened via the curved washer 25, in order to retain the pipe connection piece 9 against the wall 8 of the housing 1.

Once the pipe connection piece 9 is firmly fixed to the wall 8 the fitting part 1 in the correct rotary position with respect to the angle between the axes 5 and 6 and the sealing ring 3 is introduced into the groove 22 and the spring ring 12 into the groove 21, the fitting part 2 to be fastened can then be slipped over the pipe connection piece 9. The trapezoidal edge, that is to say the radial outer end region of the flank 36, of the elastic spring ring 12 slides over the ramp 32 and is pressed into the groove 21, until, when the fitting part 2 moves further on, said spring ring spreads into the groove 33 of this fitting part 2, so that the flanks 34 and 35 are in contact with one another in the manner of wedge surfaces. The selected dimensions are such that, in the correct rotary position of the fitting part 2, the end region 30 is in contact all-round with the outer surface 8 of the fitting part 1. This spring ring 12 therefore makes a firm connection which can no longer be pulled off. Since the shoulder or flank 34 (FIG. 5), nearer to the fitting part 1, of the groove 33 inside the fitting part 2 is designed obliquely, specifically with the same angle of incidence as in the case of the trapezoidal edge 35 of the spring ring 12 with which it comes into contact, radial bracing occurs, which ensures a play-free connection between the fitting parts 1 and 2. The small angle of incidence at the flank also brings about selflocking.

According to the present invention, therefore, the pipe 2 is pressed against the fitting part 1 by means of the spring ring 12. The spring ring 12 may also, in a known way, have, for example, circular cross section if a releasable connection is to had instead. Preferably, however, the spring ring 12 has at least one flank 35 which is inclined with respect to a plane lying at right angles to the axis of the groove, preferably the spring ring being designed radially on the inside with a rectangular cross section (35) and radially on the outside with a symmetrically trapezoidal (36) cross section.

The connection between the fitting parts 1 and 2 thereby becomes unreleasable, so that a complete unit, as a replacement for a corresponding one-piece structure is obtained. The two unreleasably connected fitting parts prove to be particularly advantageous with regard to their surface treatment. This is because a corresponding one-piece structure would be relatively difficult to clean, grind, polish, chromium-plate, lacquer, etc., particularly along the sharp contact edge between the two tubular parts. However, such surface treatments can be carried out satisfactorily in the case of the originally separate fitting parts according to the invention.

It is unimportant for the present invention whether the cross sections of the fitting parts 1 and 2 are circular or have another, for example elliptic shape The cylindrical wall 8 is therefore to be understood, in general, as the outer wall of the fitting part 1.

The connecting insert 9 is preferably designed in one piece. It may also consist of two parts, such as would be obtained, for example, by a cut along the plane of the flat wall 37 (FIG. 5) of the groove 33, because the two parts would then anyway be retained by the nut 11. In this case, a sealing ring could be inserted between the ramp 32 and the spring ring 12.

What is claimed is:

1. A fastening element for fitting parts which are designed to allow hydraulic communication between them comprising:

a connecting insert (9) mounted inside (4) of a lateral fitting part (2), wherein, the lateral fitting part (2) is provided with an inner shoulder (24) on an end face to an outer wall (8) of a wide fitting part (1) at a predetermined angle, and means to fasten the lateral fitting part to the wide fitting part and to ensure hydraulic communication between the wide and lateral fitting parts (1, 2), wherein the connecting insert (9) has at least one outer clearance (21) such that the fastening element (7) can be mounted on the lateral fitting part (2) by means of a resilient clamping piece (12) clamped between the at least one outer clearance (21) and a shoulder (24), and the clamping piece is a spring ring which has at least one flank (35) which is inclined with respect to a plane lying at right angles to a symmetry axis of the spring ring.

2. The fastening element as claimed in claim 1, wherein the connecting insert (9) comprises an axial continuous bore (15) for receiving a threaded shank (10) which is provided with an axial bore (26) and one end region (28) of which can be screwed to a threaded bore (29) of the wide fitting part (1) and on the other end region (27) of which a nut (11) can be screwed, to retain the connecting insert (9) between the nut (11) and the wide fitting part (1) connected to the threaded shank (10).

3. The fastening element as claimed in claim 1, wherein one end (16) of the connecting insert (9) is designed as a penetration to add the connecting insert, flush, to the wide fitting part (1).

4. The fastening element as claimed in claim 1, wherein the clearance is a peripherally formed groove (21).

5. The fastening element as claimed in claim 1, wherein the connecting insert (9) is designed in one piece.

6. The fastening element as claimed in claim 3, wherein a seal (14) is mounted in the region of the end (16) of the connecting insert (9) which is designed as a penetration.

7. The fastening element as claimed in claim 4, wherein the spring ring (12) has a flank (35) which is inclined with respect to a plane lying at right angles to an axis of the groove (21) of the connecting insert (9).

8. The fastening element as claimed in claim 4, wherein a further groove (22) for a sealing ring (13) is present in a region between the groove (21) of the connecting insert (9) and a nut (11).

9. The fastening element as claimed in claim 4, wherein wherein the spring ring (12) is designed radially on the inside with a rectangular cross section (35) and radially on the outside with a symmetrically trapezoidal cross section (36).

10. The fastening element as claimed in claim 1, wherein a connection between the wide and lateral fitting parts is play-free.

11. A fitting with first and second fitting parts (1, 2) selectively connected to one another, with the aid of a fastening element, wherein the second fitting part (2) is provided with an inner shoulder (24) on an end face to an outer wall (8) of the first fitting part (1) at a predetermined angle, the fastening element (7) comprising a connecting insert (9) mounted inside the second fitting part (2) and which is fastened to the first fitting part (1) to ensure hydraulic communication between the first and second fitting parts, the connecting insert (9) has at least one outer clearance (21) such that the fastening element (7) can be mounted on the second fitting part (2) with a resilient clamping piece (12) clamped between the clearance (21) and the inner shoulder (24), and the clamping piece is a spring ring (12) which has at least one flank (35) which is inclined with respect to a plane lying at right angles to a symmetry axis of the spring ring.

12. The fitting of claim 11, wherein the connecting insert further comprises an axial continuous bore (15) for receiving a threaded shank (10) which is provided with an axial bore (26) and one end region (28) of which can be screwed to a threaded bore (29) of the first fitting part (1) and on the other end region (27) on which a nut (11) can be screwed, to retain the connecting insert (9) between the nut (11) and the first fitting part (1) connected to the threaded shank (10).

13. The fitting of claim 11, wherein the clearance is a peripherally formed groove (21) and the clamping piece is a spring ring (12).

14. The fitting of claim 11, wherein the seal (14) is mounted on the end of the connecting insert (9) that meets the first fitting part (1).

15. The fitting of claim 11, wherein a connection between the first and second fitting parts is play-free.

* * * * *